United States Patent [19]

Nash et al.

[11] Patent Number: 4,513,074

[45] Date of Patent: Apr. 23, 1985

[54] STABLE CONDUCTIVE DEVELOPER COMPOSITIONS

[75] Inventors: Robert J. Nash; Kent A. Randall, both of Webster, N.Y.

[73] Assignee: Xerox Corporation, Stamford, Conn.

[21] Appl. No.: 501,666

[22] Filed: Jun. 6, 1983

[51] Int. Cl.[3] ..... G03G 9/08

[52] U.S. Cl. ..... 430/106.6; 430/109

[58] Field of Search ..... 430/109, 106.6, 110; 427/14.1

[56] References Cited

U.S. PATENT DOCUMENTS

| | | | |
|---|---|---|---|
| 3,983,045 | 9/1976 | Jugle et al. | 430/110 |
| 4,137,188 | 1/1979 | Uetake et al. | 430/111 |
| 4,267,246 | 5/1981 | Nishibayashi et al. | 430/121 |
| 4,433,042 | 2/1984 | Kawanishi et al. | 430/126 |

*Primary Examiner*—John E. Kittle
*Assistant Examiner*—John L. Goodrow
*Attorney, Agent, or Firm*—E. O. Palazzo

[57] ABSTRACT

Disclosed is an improved stable developer composition which contains resin particles, pigment particles, colloidal silica additive particles, fatty acid metal salt additive particles, and uncoated ferrite carrier particles. One preferred specific developer composition disclosed is comprised of (1) first resin particles of styrene methacrylate copolymers, grafted with or containing a low molecular weight wax composition, (2) second resin particles of a styrene, acrylate, acrylonitrile terpolymer, (3) pigment particles, (4) colloidal silica additive particles, (4) fatty acid metal salt additive particles, and (5) uncoated ferrite carrier particles.

24 Claims, No Drawings

STABLE CONDUCTIVE DEVELOPER COMPOSITIONS

BACKGROUND OF THE INVENTION

This invention is generally directed to developer compositions, and more specifically, the present invention is directed to improved conductive developer compositions possessing stable electrical properties over extended periods of time. In one embodiment of the present invention, there is provided certain improved developer compositions useful over a wide range of toner concentrations, which compositions have stable triboelectric charging properties, and desirable narrow charge distributions. Further, with the developer compositions of the present invention, there results substantially no undesirable background when these compositions are selected for the development of electrostatic latent images. Moreover, the developer compositions of the present invention desirably retain their conductivity over extended time periods.

Developer compositions for use in electrostatographic imaging systems are well known, these compositions generally being comprised of resin particles, pigment particles, and carrier particles. Many of the prior art developer compositions also contain therein various additives, such as fatty acid salts, Aerosil, and other similar materials. There is for example, described in British Pat. No. 1,442,835 developer compositions containing polystyrene resin particles, pigment particles, at least one polyalkylene compound selected from polyethylene and a polypropylene, and as an optional ingredient a paraffin wax and a metal salt of a fatty acid. According to the disclosure of this patent, the addition of a metal salt of a fatty acid provides for the improved compatibility of the polyalkylene compound in the resin component. Also, apparently the dispersion capability of the paraffin wax, pigment particles, and other toner additives, such as charge enhancing additives, is further improved with the use of zinc stearate. For example, it is stated in Column 4, beginning at line 45 of this patent that the non-sticking property of the resulting toner particles are improved, that the stability of the toner composition involved can be marketedly enhanced, and that the toners life can be sharply prolonged without being subjected to a change in frictional charge characteristics, even when the toner is used for a long period of time. Furthermore, it is indicated in this patent that the resulting toner compositions may also be improved in their moisture resisting properties.

Disclosed in U.S. Pat. No. 3,320,169 is a developer composition comprised of three components, namely magnetic carrier particles, toner particles consisting of a discrete mixture of pigmented resin particles, and an aliphatic acid having from about 10 to 26 carbon atoms, and/or salts of such aliphatic acids. Examples of fatty acids disclosed include saturated or unsaturated acids containing from 10 to 26 carbon atoms such as lauric, stearic, oleic, and the like. Preferred additives are calcium stearate and lithium stearate. Examples of thermoplastic resin particles disclosed in this patent include polystyrene resins, acrylic resins, asphalt, polyvinyl resins, and the like.

There is disclosed in U.S. Pat. No. 3,914,181, developer compositions comprised of finely divided toner particles clinging to the surface of specific carrier particles comprised of nickel zinc ferrite beads, or manganese zinc ferrite beads, which carrier particles apparently have substantially uniform properties including uniform triboelectricity, magnetic permability, and electrical conductivity. These carrier particles are obtained by preparing a slurry of ferrite forming metal oxides in a liquid, spray drying the slurry of metal oxides to form substantially metal oxide beads, followed by sintering the resulting spherical metal oxide beads. It is indicated in this patent that various toner resin materials can be selected for the developer composition involved, including phenolformaldehyde resins, methacrylate resins, polystyrene resins, polypropylene resins, epoxy resins, and the like.

It is also known that many of the developer compositions described in the prior art are useful in magnetic brush development systems, wherein there is provided developed images with excellent solid area development and desirable line development. In magnetic brush development, the electrostatic image contained on the photoreceptor imaging member, creates an electrical field for development, which results when the triboelectric attraction between the toner particles and the carrier particles is less than the electrostatic forces exerted by the latent electrostatic image. With this imaging system, as well as other similar imaging systems, there is generally selected for the developer composition carrier particles containing an insulating polymeric coating. These insulating coatings while desirable for some purposes can limit development since, for example, as the toner particles are attracted to the electrostatic latent image, there remains on the magnetic brush a counter charge which cannot dissipate rapidly in view of the presence of the insulating coating on the carrier particles. Accordingly, the accumulated counter charge effectively causes a reduction in the development field, thereby reducing the tendency for the toner particles to migrate from the magnetic brush to the latent electrostatic image contained on the imaging member. Thus, development ceases prior to neutralization of the latent image. This problem can however be avoided by incorporating multiple development rolls into the electrostatic imaging device, whereby the electrostatic latent image can be developed by successive magnetic brushes. Also, when developer compositions containing insulative carrier particles are selected for developing latent electrostatic images, the distance between the imaging member and the roller containing the developer composition must be maintained at a constant close proximity, since the strength of the development field is an inverse function of the imaging member to developer roll spacing for these particles.

Many of the above problems can be eliminated when there is selected for the developer composition electrically conductive carrier particles, in that for example, with such particles there is provided a leakage path for the counter charge associated with the removal of the toner particles from a magnetic brush, thus preventing the self limiting development phenomenon present with insulative developers. Moreover, as the conductive developer composition provides a current path from the development roller into the bristles of a development brush, the development field originating from the imaging member terminates at a point in close proximity to the tips of the magnetic brush. Therefore, the effective spacing of the development field for conductive developer compositions is not completely dependent on the distance between the imaging member and the development roll, thus a high development field can be achieved with wider spacings, approaching, for example, from about 1,500 microns to about 5,000 microns. As a result it is believed that conductive developer compositions provide a higher level of image development and a lower level of background development than insulative developer compositions. Thus the substitution of conductive developer compositions for insulative developer compositions in electrostatographic systems can allow for (1) a reduction in the number of development rolls, (2) reduce the tolerance required for the imaging member development roll spacing, and (3) provide for a development system where image development is enhanced, and undesirable background development is minimized.

Nevertheless, conductive developers do not function entirely in the manner desired, since they possess unstable conductivities, thus such developers generally increase in conductivity, or decrease in conductivity, with usage. For example, conductive developer compositions containing insulating toner particles and carrier particles consisting of a steel core coated with an oxide in an appropriate amount so as to provide the desired level of conductivity, can after extended use become more conductive in view of the loss of the oxide coating. This results in developer failure, causing a loss of the development of fine lines in a direction perpendicular to the development process, a discharge of the latent electrostatic image, and short circuits from the developer roll to the imaging member substrate. Similarly, conductive developer compositions can become insulative with use, particularly those conductive developer compositions comprised of highly impactable toner particles, that is toner particles that will permanently adhere to the surface of the carrier particles. This adherance provides an insulative region on the carrier particles, and increases the number of toner particles adhering to the carrier surface, causing the carrier particles to become less conductive, resulting in decreased developability. In imaging devices containing an automatic density control system, a decline in developability as a result of reduced conductivity in the developer composition can result in complete development failure as the addition of toner particles to the developer will limit the contacts between the carrier particles causing, for example, a decrease in the output density and resulting in some instances in images with high background densities, as well as excessive undesirable machine contamination.

Furthermore, the conductivity of a developer composition is dependent on and related to the properties of the insulative toner particles contained therein. Thus, the conductivity of a developer composition is a function of the number of toner particles contained on the surface of the conductive carrier particles. Also the conductivity for various developer compositions containing carrier particles and toner particles can be related to the carrier conductivity in that experimentally the logarithm of the developer conductivity is a linearly decreasing function of the toner concentration. For example, if the ratio of the carrier conductivity to developer conductivity is defined as R, the conductivity sensitivity parameter is defined as the natural logarithm of R divided by the toner weight percent concentration. The logarithm of the developer conductivity at a toner concentration TC, will be the logarithm of the carrier conductivity minus the product of the conductivity sensitivity parameter and the toner concentration. Similarly, the developer breakdown potential can be related to the carrier breakdown potential in that experimentally the developer breakdown potential is a linearly increasing function of the toner concentration. Thus, if the slope of this relationship is defined as the breakdown sensitivity parameter, (obtained by dividing the difference between the developer and carrier breakdown potentials by the toner concentration), the developer breakdown potential at a toner concentration TC is obtained from the carrier breakdown potential plus the product of the breakdown sensitivity parameter and the toner concentration. While it is appreciated that these relationships generally correspond to experimental data over various ranges of toner concentrations generally selected for use in xerographic imaging devices, such relationships may not generally accurately describe data obtained at very high toner concentrations.

There thus continues to be a need for improved developer compositions, particularly improved conductive developer compositions. Additionally, there continues to be a need for improved developer compositions which retain their conductivity for extended time periods. Moreover, there continues to be a need for improved developer compositions containing stable triboelectric charging values, and narrow charge distributions, in order to allow for the use of such compositions over a wide range of toner concentrations. Further there continues to be a need for conductive developer compositions which when selected for use in xerographic imaging systems results in images with minimum or substantially no undesirable background development.

SUMMARY OF THE INVENTION

It is an object of the present invention to provide improved developer compositions which overcome the above-noted disadvantages.

In another object of the present invention there are provided improved conductive developer compositions.

In yet another object of the present invention there are provided developer compositions which retain their conductivity over extended time periods, and which contain stable triboelectric charging values.

In another object of the present invention there are provided improved conductive compositions containing uncoated ferrite carrier particles.

In a further object of the present invention there are provided improved conductive developer compositions containing certain resin particles, specific additives, and uncoated ferrite carrier particles.

In yet a further object of the present invention there are provided developer compositions containing as additives low molecular weight waxes, silica particles, and metal salts of a fatty acid.

These and other objects of the present invention are accomplished by the provision of improved developer compositions which retain their conductivity over extended time periods, which compositions are comprised of certain toner resin particles, pigment particles, colloidal silica particles, additive particles, and carrier particles comprised of uncoated ferrite cores. In one embodiment of the present invention, there are provided developer compositions of certain stable conductivities, comprised in combination of (1) first toner resin particles of styrene methacrylate copolymers, or related copolymers, grafted with, or containing a low molecular weight wax, (2) second toner resin particles of terpolymers of styrene, acrylate, and acrylonitrile, (3) pigment particles (4) colloidal silica particles, (5) additive particles comprised of the metal salts of fatty acids, and (6) carrier particles comprised of uncoated ferrite cores.

In one preferred embodiment of the present invention, there are provided improved conductive developer compositions comprised in combination of (1) first toner resin particles consisting essentially of a styrene methacrylate resin copolymer, grafted with, or containing a low molecular weight wax, (2) second toner resin particles consisting essentially of a terpolymer of styrene, acrylate, and acrylonitrile, (3) pigment particles, (4) colloidal silica particles, (5) additive particles consisting essentially of the metal salts of fatty acids, and (6) carrier particles consisting essentially of uncoated ferrite cores. In one specific preferred embodiment of the present invention, the improved conductive developer composition is comprised of (1) a styrene n-butylmethacrylate copolymer resin, containing therein, or grafted with a low molecular weight polypropylene, or polyethylene wax, (2) a terpolymer resin comprised of a crosslinked styrene butylacrylate acrylonitrile composition, (3) pigment particles comprised of carbon black, (4) colloidal silica particles, (5) zinc stearate particles, and (6) uncoated carrier particles containing a ferrite core comprised of metal oxides, reference for example, U.S. Pat. No. 3,914,181, the disclosure of which is totally incorporated herein by reference.

The conductive developer compositions of the present invention have a number of suitable desirable properties, including a stable conductivity over extended time periods, wide toner concentration ranges, and relative insensitivity to humidities ranging from about 20 percent to about 80 percent at temperatures of from 60° F. to 80° F. Also when selected for use in xerographic imaging systems, the conductive developer compositions of the present invention provide images with minimum background or substantially no undesirable background.

The improved conductive developer compositions of the present invention also possess other important desirable properties, including for example, stable triboelectric charging values ranging from about 10 microcoulombs per gram to about 40 microcoulombs per gram, and preferably from about 15 microcoulombs per gram to about 35 microcoulombs per gram for over 5 hours mixing time. Moreover, the conductive developer compositions of the present invention have desirable conductivity sensitivity parameters, desirable breakdown sensitivity parameters, suitable carrier breakdown potentials, and suitable carrier conductivities. Thus, for example, the developer compositions of the present invention have carrier conductivities ranging from about $10-9$ ohm·cm$^{(-1)}$ to about $10-12$ ohm·cm$^{(-1)}$, a carrier breakdown potential greater than 1,000 volts and a conductivity sensitivity parameter of from about 0.1 to about 0.9.

Many known methods may be used for preparing the toner compositions of the present invention, one method involving melt blending the first resin particles, the second resin particles, the additive particles and the pigment particles, followed by mechanical attrition. Thus, the toner compositions of the present invention can be prepared by melt blending the first resin particles, the second resin particles, the pigment particles, the colloidal silica particles, the additive particles of the metal salts of fatty acids, followed by mechanical attrition. Other similar methods include those well known in the art such as spray drying, melt dispersion, and dispersion polymerization.

Illustrative examples of resins that may be grafted with a low molecular weight wax, or contain a wax therein, and thus useful as the first resin particles for the toner compositions of the present invention includes numerous known suitable resins such as polyesters, such as those resulting from the reation of a dicarboxylic acid and a diol, styrene butadiene copolymers, styrene methacrylates, especially styrene n-butylmethacrylate copolymers, containing from about 65 percent by weight of styrene, and about 35 percent by weight of n-butylmethacrylate, or about 58 percent by weight of styrene, and about 42 percent by weight of n-butylmethacrylate, polyamides, epoxies, polyurethanes, and vinyl resins. Suitable vinyl resins include homopolymers or copolymers of two or more vinyl monomers. Typical examples of vinyl monomeric units include: styrene, p-chlorostyrene vinyl napthalene, vinyl chloride, vinyl bromide, vinyl fluoride, ethylenically unsaturated mono-olefins such as ethylene, propylene, butylene, isobutylene and the like; vinyl esters such as vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalphachloroacrylate, methyl methacrylate, ethyl methacrylate, butyl methacrylate and the like; vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof. The styrene, butylmethacrylate copolymers grafted with, or containing a low molecular weight wax, are commercially available from Sanyo Inc. Co. a Japanese corporation.

Illustrative examples of the second resin particles useful in the present invention as toner resin particles are terpolymer resins, believed to be crosslinked, which resins are commercially available from Nippon Zeon Co. Ltd., a Japanese corporation and are believed to be comprised of a terpolymer of styrene, acrylate, such as butylacrylate, and acrylonitrile. In one illustrative embodiment it is believed that the Nippon Zeon Co. Ltd., terpolymer resin contains styrene in an amount of from about 55 percent by weight to about 60 percent by weight, butylacrylate in an amount of from about 30 percent by weight to about 35 percent by weight, and acrylonitrile in an amount of from about 5 percent by weight to about 10 percent by weight.

The resin particles are present in the developer composition, (toner particles plus carrier particles) in an amount of from about 40 percent by weight to about 90 percent by weight, and preferably from in an amount of from about 70 percent by weight to about 90 percent by weight.

In one preferred embodiment of the present invention, the first resin particles comprised of a styrene methylmethacrylate copolymer, are present in an amount of from about 30 percent by weight to about 75 percent by weight, while the second terpolymer resin particles are present in an amount of from about 15 percent by weight to about 60 percent by weight.

The first resin particles are believed to have been grafted with, or may contain, a low molecular weight wax. The waxy material is believed to have a molecular weight of from about 500 to about 20,000, and preferably of from about 1,000 to about 5,000.

Illustrative examples of useful low molecular weight waxy materials include polypropylenes and polyethylenes commercially available from Allied Chemical and Petrolite Corporation, Epolene N-15, commercially available from Eastman Chemical Products Incorporation, Viscol 550-P, a low moecular weight polypropylene available from Sanyo Kasei K.K., and similar materials. The commercially available polyethylenes selected have a molecular weight of from about 1,000 to about 1,500, while the commercially available polypropylenes incorporated into the toner compositions of the present invention are believed to have a molecular weight of from about 4,000, to about 5,000. Many of the polyethylene and polypropylene compositions useful in the present invention are illustrated in British Pat. No. 1,442,835.

The low molecular weight wax materials, such as low molecular weight polyethylenes and polypropylenes are present in the toner composition of the present invention in various amounts, however, generally these waxes are present in the toner composition in an amount of from about 1 percent by weight to about 10 percent by weight, and preferably in an amount of from about 2 percent by weight to about 5 percent by weight.

Various suitable colorants, and/or pigment particles may be incorporated into the developer compositions of the present invention, and more specifically into the toner particles, such materials being well known and including for example, carbon black, and Nigrosine dye, and the like. The pigment particles are present in the toner in sufficient quantities so as to render the toner composition highly colored in order that it will form a visible image on the recording member. Thus, for example, the pigment particles, should be present in the toner composition in an amount of from about 2 percent by weight to about 15 percent by weight, and preferably in an amount of from about 2 percent by weight to about 10 percent by weight.

The improved conductive developer compositions of the present invention also contain two important additive components, namely, silica particles, and particles comprised of fatty acids or the metal salts thereof. Examples of silica particles include those comprised of colloidal silica, commercially available as Aerosil, such as Aerosil R972, and the like. Generally, the silica particles are present in the developer composition in an amount of from about 0.1 percent by weight to about 1 percent by weight based on the weight of the toner particles. In one preferred embodiment the silica particles are present in an amount of 0.7 percent by weight.

Illustrative examples of fatty acids or fatty acid salts incorporated into the developer composition of the present invention include those as described in U.S. Pat. No. 3,320,169, the disclosure of which is totally incorporated herein by reference. These acids generally contain from about 10 to about 26 carbon atoms, such as lauric acid, palmitic acid, stearic acid, oleic acid, or the calcium, barrium, zinc, nickel salts of these acids. Specific preferred metal fatty acid additives selected are zinc stearate and calcium stearate.

Generally the fatty acid, or the metal salt of the fatty acid is present in an amount of from about 0.1 percent by weight to about 1 percent by weight based on the weight of the toner particles, and preferably in an amount of from about 0.1 percent by weight to about 0.80 percent by weight. In one preferred embodiment of the present invention, the developer composition contains about 0.7 percent by weight of zinc stearate.

Illustrative examples of carrier particles useful in the present invention include those disclosed in U.S. Pat. No. 3,914,181, the disclosure of which is totally incorporated herein by reference. Specific illustrative examples of carrier particles include uncoated ferrite beads containing for example, zinc, nickel ferrites, maganese zinc ferrites, and the like. One useful carrier material is a nickel zinc ferrite with the nominal composition $Ni_{0.307}Zn_{0.619}Mn_{0.0493}Cu_{0.0249}Fe_{1.944}$.

Developer compositions of the present invention were generally prepared by mixing from about 1 part to about 3 parts by weight of the toner composition, containing both the first resin particles and the second resin particles with 100 parts of uncoated ferrite carrier particles. By toner composition in accordance with the present invention is meant a composition comprised of first resin particles, with wax, second terpolymer resin particles, pigment particles and additive particles, such as silica particles and zinc stearate particles.

The developer compositions of the present invention can be selected for causing the development of electrostatic latent images, particularly those images contained on an imaging member charged either negatively or positively. Thus, for example, the toner compositions of the present invention can be charged positively for use in developing latent images charged negatively, by incorporating therein known charge enhancing additives, such as alkyl pyridinium halides, sulfone or sulfonate compositions, such as stearyl dimethyl phenethyl ammonium para-toulene sulfate. Examples of imaging surfaces that may be selected include known photoreceptor compositions, particularly inorganic photoreceptor compositions such as selenium, alloys of selenium, including selenium arsenic, selenium tellurium, selenium tellurium arsenic, and the like. Preferred photoconductive members include selenium and a selenium tellurium alloy, containing from about 70 to 99 percent by weight of selenium and from about 30 percent to about 1 percent by weight of tellurium.

Additionally, there can be selected for use with the developer composition of the present invention organic photoreceptor materials, including layered organic photoresponsive devices such as those described in U.S. Pat. No. 4,265,990, the disclosure of which is totally incorporated herein by reference. These layered devices contain a substrate, a photogenerating layer, and a transport layer. Examples of photogenerating layers include trigonal selenium, metal phthalocyanines, metal free phthalocyanines, and vanadyl phthalocyanines, while examples of transport materials including various diamines dispersed in resinous binders.

The imaging method of the present invention involves the formation of an appropriately charged electrostatic latent image, such as a positively charged latent image on a suitable imaging member, contacting the image with the developer composition of the present invention, followed by transferring the developed image to a suitable substrate, such as paper, and permanently affixing the image thereto by various suitable means such as heat.

In addition to heat, other fixing means can be selected including roll fusing, radiant fusing, and the like. Thus, for example, when the developer composition contains toner resin particles comprised of styrene methacrylate copolymers, fixing can be accomplished by roll fusing with a silicon roll, while when the developer composition contains polyester toner resins, radiant fusing may be used for accomplishing fixing of the toner images. Moreover, for example, when the developer composition contains a mixture of toner resins, that is a first resin containing a styrene copolymer, and a second terpolymer resin, which toner composition has incorporated therein a low molecular weight waxy material, roll fusing can be selected. In this embodiment, a release fluid, such as a silicone oil, for toner offset, is not needed since the toner composition containing the mixture of resins, and low molecular weight wax, prevents toner offset without a toner release fluid.

With regard to the working examples that follow, the aging fixture selected consists of a developer housing with a single development roll moving in the same direction as a photoreceptor drum comprised of a selenium tellurium alloy deposited on an aluminum substrate. Specifically, the selenium alloy was comprised of about 75 percent by weight of selenium and about 25 percent by weight of tellurium. This photoreceptor was maintained in a discharged state, in that it discharged to substantially zero volts by a fluorescent lamp. In this device, the housing was sequentially electrically biased with 95 volts DC, and −395 volts DC so as to result in background development for 90 percent of the drum cycle, and solid area image development for 10 percent of the cycle. The density of the background and image patches on the photoreceptor was monitored continuously by an infrared sensor. The output of the sensor controlls the toner dispensing system, in that this sensor determines the amount of toner that was added to the developer housing, and hence to the electrostatic image. The imaged toner was removed after each cycle, by a brush cleaner, proceeded by dicorotron charging, in order to provide a clean selenium alloy photoreceptor for each development step. Using this aging device, key developer composition properties were measured at set intervals, these properties including carrier conductivity, carrier breakdown potential, toner concentration, the conductivity sensitivity parameter and the breakdown sensitivity parameter. Graphs of these properties plotted as a function of aging time, with one hour of aging in the aging fixture being equal to approximately 1,000 copies, can be used to asses developer performance.

Additionally, the developers of the present invention were compared with prior art developers for their print making abilities in a complete xerographic imaging apparatus. This apparatus contained a development system similar to that used for the aging fixture described herein with the exception that the xerographic machine contained a blade cleaning system instead of a brush cleaning device The imaging apparatus was fitted with an electrostatic voltmeter probe in order that image potentials could be measured for various input densities. Further, the developer bias voltage was controlled at various fixed levels by an external power supply and as a result the observed output densities, both image and background, could be determined against various development potentials. These measurements were accomplished at various developer times and at various temperature humidity combinations. This data has been summarized in the working examples as the toner concentration latitude. Thus, there is a specific allowable image density, for example, an output density of 1.1 optical density, from a 1.0 optical density image input, and a specific maximum allowable background density, for example a 0.010 optical density. By labeling the toner concentrations at which these specific densities are achieved as $TC_1$ and $TC_2$, respectively, a wide developer latitude will correspond to $TC_2$, being much greater about 5 units larger than $TC_1$, while an undesirable developer latitude will have a $TC_2$ smaller or equal to $TC_1$. Accordingly, in the latter situation, developer failure will occur in that the background areas will be developed at densities above the maximum specified values before the image is developed at the specified density.

Also, in the examples, that follow, the conductivity sensitivity parameter values are an indication of developer utility in that a large value for this parameter, greater than about 5, indicates that the developer composition will rapidly become insulating at reasonable toner concentrations, about 2 percent. Conversely, a small value for the conductivity sensitivity parameter, for example less than about 2 indicates that the developer composition will remain conductive over a wide range of toner concentrations, about 5 percent. Likewise, the breakdown sensitivity values are an indication of developer utility in that a high value for this parameter, over 50, will result in a high value for developer breakdown and thus avoid problems associated with low breakdown values, which translates into image loss. Further, a low value for this parameter coupled with low carrier breakdown potential is undesirable since a developer composition possessing these values will breakdown at low voltages over a wide range of toner concentrations.

The carrier conductivity values and sensitivity parameters reported in the Examples were obtained by measurements in a magnetic brush device. In this device, the carrier composition, or developer composition was placed on a 1.5" diameter magnetic roll, followed by measuring the conductivity with an electrical probe. This conductivity was obtained by measuring with a probe the amount of current which passes through the carrier composition or the developer composition to a measurement electrode for a specific applied voltage V. The measurement electrode, surrounded by a grounded guard plate has a surface area of 3.0 $Cm.^2$ and the developer roll to electrode spacing was 2.54 millimeters. For these spacings, the cell constant was 0.0847 $cm^{-1}$ (0.254 divided by 3.0), and the carrier conductivity or the developer conductivity, in $(ohm\text{-}cm)^{31\ 1}$, is the cell constant multiplied by the current divided by the applied voltage.

This measurement device was also used to measure the breakdown potential of the carrier particles or developer composition, that is the potential at which these components began to conduct large electrical currents, that is currents approaching 0.1 milliamps.

Also the developer composition of the present invention can be comprised of first resin particles, pigment particles, colloidal silica particles, additive particles, and carrier particles comprised of uncoated ferrite cores.

The invention will now be described in detail with respect to specific preferred embodiments thereof, it being understood that these Examples are intended to be illustrative only and the invention is not intended to be limited to the materials, conditions, process parameters, recited herein. All parts and percentages are by weight unless otherwise indicated.

EXAMPLE I

There was prepared by melt blending followed by mechanical attrition a control developer composition containing 2 parts of a toner composition comprised of 89.5 percent of a styrene n/butylmethacrylate copolymer, 58 percent by weight of styrene, and 42 percent by weight of n-butylmethacrylate, 10.5 percent by weight of Regal 5750 carbon black, 0.65 weight percent of Aerosil R972, available from Degussa Inc. 0.35 percent by weight of powdered zinc stearate, available from Diamond Shamrock, the Aerosil and zinc stearate functioning as external additives, and 98.0 parts by weight of a carrier consisting of a steel core containing 1.6 weight percent of a semi-continuous partial coating of polymethyl methacrylate.

The resulting developer composition had a stable triboelectric charge value for 25 hours of 22 to 24 microcoulombs per gram of toner, at a toner concentration of about 1.4 weight percent, as determined by the known Faraday cage method, and further this developer remains substantially unchanged over 25 hours of aging in an aging fixture.

This developer composition had the following measured properties as determined in the aging test fixture disclosed herein. The specific values reported were arrived at as indicated herein.

| Hours of Aging in Aging Fixture | Carrier Conductivity $(ohm \cdot cm)^{-1}$ | Carrier Breakdown Potential (volts) | Conductivity Sensitivity Parameter $(Toner\ Concentration)^{-1}$ | Breakdown Sensitivity Parameter (Volts × Toner Concentration$^{-1}$) |
|---|---|---|---|---|
| 0 | $8 \cdot 10^{-10}$ | 560 | 1.7 | 57 |
| 25 | $6 \cdot 10^{-6}$ | 65 | 0.9 | 7 |

When imaged this developer composition had a toner concentration latitude of 1.8 weight percent, in an electrostatic imaging apparatus containing a photoconductive member comprised of a selenium tellurium alloy, 99 percent by weight of selenium and 1 percent by weight of tellurium, deposited on an aluminum substrate, however the rapid age-induced decline in carrier breakdown potential, a decrease of from 560 volts to 65 volts, produced shorting to the aluminum photoreceptor substrate resulting in image failure after 5,000 copies had been developed. Subsequent to 5,000 copies, images produced contained essentially all undesirable background.

This developer thus remains useful as a conductive developer for a very short period of time, with developer failure occurring in view of a decrease in the breakdown potential of the carrier particles, and a decrease in the breakdown sensitivity parameter of from 57 to 7 over a period of 25 hours of aging By failure is meant that images developed contained substantially all undesirable background.

EXAMPLE II

There was prepared a control developer composition by repeating the procedure of Example I with the exception that 98 parts by weight of the same carrier were mixed with 2 parts by weight of a toner composition comprised of 88.5 percent of a polyester resin, based on the reaction product of bis-phenol A, propylene oxide, and fumaric acid, and 11.5 percent by weight of carbon black. There was blended into the toner composition by jet injection, 0.65 weight percent by weight of fumed silica, available as Aerosil R972 from Degussa and 0.35 percent by weight of powdered zinc stearate. commercially available from Diamond Shamrock.

The resulting developer composition had a triboelectric value of about 34 microcoulombs per gram of toner, at a toner concentration of about 1.3 weight percent, as determined by the Faraday cage technique, and evidenced a 20 percent decline in triboelectric charge over 45 hours of aging in the aging fixture.

This developer composition had the following mesured values obtained in accordance with the procedure as described in Example I.

| Hours of Aging in Aging Fixture | Carrier Conductivity $(ohm \cdot cm)^{-1}$ | Carrier Breakdown Potential (volts) | Conductivity Sensitivity Parameter $(Toner\ Concentration)^{-1}$ | Breakdown Sensitivity Parameter (Volts × Toner Concentration$^{-1}$) |
|---|---|---|---|---|
| 0 | $4 \cdot 10^{-10}$ | 580 | 1.6 | 70 |
| 45 | $4 \cdot 10^{-9}$ | 190 | 9.3 | 300 |

While the carrier particles contained in the developer composition of this Example became more conductive with age, the developer was increasingly insulative with age in view of the age-induced increase in the conductivity sensitivity parameter. This developer is an example of a conductive developer composition which when selected for use in developing images in the xerographic imaging fixture of Example I, results in eventual image failure, after about 25 hours in view of the age-induced loss of conductivity.

EXAMPLE III

There was prepared by melt blending followed by mechanical attrition a developer composition comprised of 98 parts by weight of a carrier 100 microns in diameter consisting of an uncoated nickel, zinc, ferrite core, with the nominal composition $Ni_{0.307}Zn_{0.619}Mn_{0.0493}Cu_{0.0249}Fe_{1.944}$(measured average values Ni—7.3%, Zn—16.1%, Mn—1.1%, Cu—0.6%, Fe47.1%) and a conductivity of $10-^{11}$ ohm-cm$^{31\ 1}$, and 2 parts by weight of a toner composition comprised of 47.2 weight percent of second resin particles of a terpolymer containing styrene, n-butyl acrylate, and acrylontrile, commercially available from Nippon Zeon, 38.6 percent by weight of first resin particles of a a polystyrene n-butylmethacrylate copolymer resin, with 1.75 percent by weight of the low molecular weight polypropylene wax, available from Sanyo, and 12.5 percent by weight of Black Pearls carbon black particles available from Cabot Corporation, which toner composition also contains 0.7 weight percent of Aerosil R972, and 0.5 percent by weight of powdered polyvinylidene fluoride as external additives.

The resulting developer composition had a triboelectric value of about 35 microcoulombs per gram of toner, at a toner concentration of about 4.0 weight percent, as determined by the Faraday cage technique, and evidenced little change in these values during 25 hours of aging in an aging fixture. The carrier breakdown potential was above 1,000 volts at all ages.

This developer composition had the following measured values obtained in accordance with the procedure as described in Example I.

| Hours of Aging in Aging Fixture | Carrier Conductivity (ohm · cm)$^{-1}$ | Conductivity Sensitivity Parameter (Toner Concentration)$^{-1}$ |
|---|---|---|
| 0 | $5 \cdot 10^{-11}$ | 1.5 |
| 25 | $2 \cdot 10^{-12}$ | 3.0 |

After only limited aging this developer was insulating in that the developer conductivity was found to be below the measurement limit, that is below about $2 \cdot 10^{-16}$ ohm-cm$-1$. When new, and without aging, this developer composition had a toner concentration latitude of $-0.03$ weight percent in the imaging apparatus described in Example I. Thus, when selected for developing images in accordance with Example I, there resulted images with undesirable background after a few imaging cycles, which background became substantial as the developer aged.

There was then added to the above developer composition 0.1 weight percent of powered zinc stearate prior to accomplishing any aging tests and developer conductivity increased from $1 \cdot 10^{-13}$ (ohm·cm)$^{-1}$ to $7 \cdot 10^{-12}$ (ohm·cm)$^{-1}$ at a toner concentration of about 3.5 weight percent.

EXAMPLE IV

A developer composition was prepared by repeating the procedure of Example III with the exception that there was incorporated into the toner composition as external additives, 0.7 percent by weight of Aerosil R972, and 0.35 percent by weight of powdered zinc stearate, based on the weight of the toner particles.

The resulting developer composition had a triboelectric charge value of about 30 microcoulombs per gram of toner, as determined by the Faraday cage technique, a toner concentration of 3.5 percent by weight, and evidenced substantially no change in these values during 25 hours of aging in an aging fixture. The carrier breakdown potential was above 1,000 volts at all ages.

This developer composition had the following measured values determined in accordance with the procedure as described in Example I.

| Hours of Aging in Aging Fixture | Carrier Conductivity (ohm · cm)$^{-1}$ | Conductivity Sensitivity Parameter (Toner Concentration)$^{-1}$ |
|---|---|---|
| 0 | $1 \cdot 10^{-11}$ | 0.3 |
| 25 | $6 \cdot 10^{-12}$ | 0.6 |

The above data establishes that the conductivity of the developer of this Example was stable with regard to age and toner concentration. When examined in the imgaging apparatus of Example I, this developer was found to have a toner concentration latitude of $+2.5$ percent by weight, and after 25 hours of aging in an aging fixture, the toner concentration latitude was 1.1 percent by weight. There was obtained with the developer composition of this Example good quality images with minimal background after 25 hours of aging in the aging fixture. Also, the carrier conductivity was stable $1 \cdot 10^{-11}$ (ohm-cm)$-1$ and $6 \cdot 10^{-12}$ at 25 hours.

EXAMPLE V

A developer composition was prepared by repeating the procedure of Example III with the exception that there was incorporated into the toner composition as external additives, 0.7 percent by weight of Aerosil R972, and 0.7 percent by weight of powdered zinc stearate.

The resulting developer composition had a triboelectric charge value of about 30 microcoulombs per gram of toner, as determined by the Faraday cage technique, a toner concentration of 3 percent by weight, and evidenced substantially no change in these values during 50 hours of aging in the aging fixture.

This developer composition had the following measured values as determined in accordance with the procedure of Example I.

| Hours of Aging in Aging Fixture | Carrier Conductivity (ohm · cm)$^{-1}$ | Conductivity Sensitivity Parameter (Toner Concentration)$^{-1}$ |
|---|---|---|
| 0 | $1 \cdot 10^{-11}$ | 0.3 |
| 50 | $8 \cdot 10^{-12}$ | 0.3 |

When examined in the imaging apparatus of Example I, the unaged developer had a toner concentration latitude of $+4.9$ percent by weight, and after 50 hours of aging in an aging fixture, the toner concentration latitude was 3.9 percent by weight. There resulted images of good quality, excellent resolution, and substantially no background even after 50 hours of aging in the aging fixture when the developer composition of this Example was selected for use in the imaging apparatus of Example I containing the selenium tellurium photoreceptor.

EXAMPLE VI

There was prepared by melt blending followed by mechanical attrition a developer composition containing 98 parts by weight of the uncoated ferrite carrier, of Example III and 2 parts by weight of a toner composition comprised of 67.5 weight percent of first resin particles of a styrene/n-butylmethacrylate copolymer, 80 percent by weight of styrene, 20 percent by weight of a n-butylmethacrylate resin, and 7 percent by weight of a low molecular weight polypropylene wax, which first resin particles are available from Sanyo Kasai Chemical Company and 22.5 percent by weight of second resin particles of a styrene,butyl acrylate, acrylonitrile, terepolymer crosslinked with divinylbenzene, available from Nippon Zeon, and 10 percent by weight of carbon black, Black Pearls 1300, available from Cabot Corporation. There was then blended into the toner composition 0.7 percent by weight of Aerosil R792, and 0.35 weight percent of powdered zinc stearate as external additives, this blending being effected in a 130D Lodige blender.

The resulting developer composition had a triboelectric charge value of 35 microcoulombs per gram of toner, as determined by the Faraday cage method, a toner concentration of about 3.3 weight percent, and evidenced substantially no change in these values during 50 hours of aging in an aging fixture. The carrier breakdown potential was above 1,000 volts at all ages.

This developer composition had the following measured values as determined in accordance with the procedure of Example I.

| Hours of Aging in Aging Fixture | Carrier Conductivity (ohm · cm)$^{-1}$ | Conductivity Sensitivity Parameter (Toner Concentration)$^{-1}$ |
|---|---|---|
| 0 | $1 \cdot 10^{-11}$ | 0.8 |
| 50 | $3 \cdot 10^{-11}$ | 0.9 |

When the developer composition of this Example was examined in the imaging apparatus of Example I, the unaged developer had a toner concentration latitude of +2.3 percent by weight, indicating a low tendency to generate background.

EXAMPLE VII

A developer composition was prepared by repeating the procedure of Example VI with the exception that the toner composition contained as external additives. 0.7 percent by weight of Aerosil R972 and 0.7 percent by weight of powdered zinc stearate.

The resulting developer composition had a triboelectric charge value of 34 microcoulombs per gram of toner, as determined by the Faraday cage technique, at a toner concentration of 3 percent by weight, and this developer composition evidenced substantially no change in these values during 25 hours of aging in the aging fixture. The carrier breakdown potential was above 1,000 volts for all ages.

This developer composition has the following measured values as determined in accordance with the procedure of Example I.

| Hours of Aging in Aging Fixture | Carrier Conductivity (ohm · cm)$^{-1}$ | Conductivity Sensitivity Parameter (Toner Concentration)$^{-1}$ |
|---|---|---|
| 0 | $1 \cdot 10^{-11}$ | 0.5 |
| 25 | $7 \cdot 10^{-12}$ | 0.6 |

The above data indicates that the developer conductivity has only a small sensitivity to toner concentration, 0.6, and to developer aging, that is the developer will operate as a conductive developer over a wide range of toner concentrations for 25 hours.

EXAMPLE VIII

There was prepared by melt blending followed by mechanical attrition a control developer composition containing 98 parts by weight of the uncoated ferrite carrier of Example III, and 2 parts by weight of a toner composition comprised of 89.5 weight percent of a polystyrene n-butylmethacrylate copolymer resin, containing 58 percent of polystyrene, and 42 percent by weight of n-butylmethacrylate; and 10.5 weight percent of R5750 carbon black.

The resulting developer composition had a triboelectric charge value of 20 microcoulombs per gram of toner, as determined by the Faraday Cage method, and a toner concentration of about 1.5 weight percent. This developer was examined in an aging fixture in accordance with Example I for 25 hours with the following results:

| Hours of Aging in Aging Fixture | Carrier Conductivity (ohm · cm)$^{-1}$ | Conductivity Sensitivity Parameter (Toner Concentration)$^{-1}$ |
|---|---|---|
| 0 | $2 \cdot 10^{-11}$ | 3.5 |
| 31 | $1.6 \cdot 10^{-11}$ | 3.5 |

The carrier breakdown potential was above 1,000 volts for all ages.

The above data indicates that while the carrier conductivity of this developer remains substantially unchanged with age, the large conductivity sensitivity parameter value indicates that this developer will cease to be conductive at toner concentrations above 3 weight percent.

EXAMPLE IX

A developer composition was prepared by repeating the procedure of Example VIII with the exception that there was added as external additives to the toner composition, 0.65 percent by weight of Aerosil R972 and 0.35 percent by weight of powdered zinc stearate.

The resulting developer composition had a triboelectric charge value of 30 microcoulombs per gram of toner, as determined by a Faraday cage technique, and a toner concentration of 2.5 percent by weight.

This developer composition remains substantially unchanged during 31 hours of aging in the aging fixture, in that the triboelectric charge values and toner concentration values were identical. The carrier breakdown potential was above 1,000 volts at all ages.

This developer composition had the following measured values as determined in accordance with the procedure of Example I.

| Hours of Aging in Aging Fixture | Carrier Conductivity (ohm · cm)$^{-1}$ | Conductivity Sensitivity Parameter (Toner Concentration)$^{-1}$ |
|---|---|---|
| 0 | $3 \cdot 10^{-11}$ | 0.5 |
| 31 | $1 \cdot 10^{-11}$ | 0.4 |

The above data demonstrates the dramatic effect of the additives, about 7 times reduction in the conductivity sensitivity parameter as compared to the toner composition of Example VIII. When this developer composition was selected for use in developing images in the imaging fixture of Example I, there was obtained excellent images of good resolution with substantially no background over a period of 31 hours.

EXAMPLE X

There was prepared a developer composition by melt blending followed by mechanical attrition, which composition contained 98 parts by weight of the uncoated ferrite carrier of Example III, and 2 parts by weight of a toner composition containing 88.5 weight percent of a polyester resin obtained from the reaction product of bis-phenol A, propylene glycol and fumaric acid, and 11.5 percent by weight black pearls carbon black. There was blended into the toner composition by jet injection, 0.65% by weight of fumed silica, Aerosil R972, and 0.35% by weight of powered zinc stearate.

The resulting developer composition had a triboelectric charge value of 40 microcoulombs per gram of toner, as determined by the Faraday cage method, at a toner concentration of about 2.3 weight percent, and this developer composition remained substantially unchanged in these values during 50 hours of aging in an aging fixture. The carrier breakdown potential was above 1,000 volts at all ages.

This developer composition had the following measured values as determined in accordance with the procedure of Example I.

| Hours of Aging in Aging Fixture | Carrier Conductivity $(ohm \cdot cm)^{-1}$ | Conductivity Sensitivity Parameter (Toner Concentration)$^{-1}$ |
|---|---|---|
| 0 | $1.4 \cdot 10^{-11}$ | 1.2 |
| 31 | $1.5 \cdot 10^{-11}$ | 0.9 |

The above data indicates that the developer composition of this Example will function as a conductive developer over a wide range of toner concentrations, without any appreciable decline in conductive properties over an extended aging period of up to 31 hours.

EXAMPLE XI

There was prepared a developer composition by melt blending followed by mechanical attrition, which developer composition contained 98 parts by weight of a uncoated ferrite carrier having a high conductivity of $10^{-9}$ ohm·cm$^{-1}$, rather than $10^{-11}$ ohm·cm$^{-1}$ for the carrier of Example III, and 2 parts by weight of a toner composition containing 67.5 weight percent of first resin particles of a styrene/n-butylmethacrylate resin, containing 80 percent of polystyrene, 20 percent by weight of n-butylmethacrylate, and 7 percent by weight of polypropylene, which first resin particles are available from Sanyo Kasei Chemical Co., Ltd., 22.5 percent by weight of styrene, n-butylmethacrylate acrylonitrile, crosslinked with divinylbenzene, available from Nippon Zeon, and 10 percent by weight of carbon black, BP1300, available from Cabot Corporation. There was blended into the toner composition 0.7 percent by weight of Aerosil R792, and 0.35 weight perent of zinc stearate as external additives, this blending being effected in a 130D Lodige blender.

The resulting developer composition had a triboelectric charge value of 22 microcoulombs per gram of toner, as determined by the Faraday cage method, at a toner concentration of about 1.8 weight percent, and this developer composition remained substantially unchanged in these values during 40 hours of aging in an aging fixture. The carrier breakdown potential was above 1,000 volts at all ages.

This developer composition had the following measured values as determined in accordance with the procedure of Example I.

| Hours of Aging in Aging Fixture | Carrier Conductivity $(ohm \cdot cm)^{-1}$ | Conductivity Sensitivity Parameter (Toner Concentration)$^{-1}$ |
|---|---|---|
| 0 | $1 \cdot 10^{-9}$ | 0.1 |
| 40 | $1 \cdot 10^{-9}$ | 0.1 |

This Example demonstrates that the developer composition which contains a carrier having increased conductivity as compared to the carrier of Example II results in stable performance, with exceptional in sensitivity of conductivity to toner concentration and developer age.

Although the invention has been described with reference to specific preferred embodiments, it is not intended to be limited thereto, rather those skilled in the art will recognize variations and modifications may be made therein which are within the spirit of the invention and within the scope of the following claims.

We claim:

1. An improved stable two-component conductive developer having a toner composition consisting essentially of (1) first resin particles of styrene methacrylate copolymers, grafted with or containing a low molecular weight wax composition, (2) second resin particles of a styrene, acrylate, acrylonitrile terpolymer, (3) pigment particles, (4) colloidal silica additive particles, (5) fatty acid metal salt additive particles, and (6) uncoated ferrite carrier particles.

2. An improved stable conductive developer composition in accordance with claim 1 wherein the first resin particles are comprised of a styrene n/butylmethacrylate copolymer.

3. An improved developer composition in accordance with claim 1 wherein the first resin particles are comprised of a styrene n-butylmethacrylate copolymer resin containing 58 percent by weight of styrene and 42 percent by weight of n-butylmethacrylate, or 65 percent by weight of styrene, and 35 percent by weight of n-butylmethacrylate.

4. An improved stable conductive developer composition in accordance with claim 1 wherein the second resin particles are comprised of a crosslinked terpolymer resin of styrene, butylacrylate, and acrylonitrile.

5. An improved stable conductive developer composition in accordance with claim 1 wherein the pigment particles are carbon black.

6. An improved stable conductive developer composition in accordance with claim 1 wherein the colloidal silica particles are comprised of silica oxide particles.

7. An improved stable conductive developer composition in accordance with claim 1 wherein the fatty acid metal salt additive particles are comprised of zinc stearate.

8. An improved stable conductive developer composition in accordance with claim 1 wherein the uncoated ferrite carrier particles are comprised of iron, zinc, and maganese.

9. An improved stable conductive developer composition in accordance with claim 1 wherein the uncoated ferrite carrier particles are comprised of iron, copper, nickel, zinc, and maganese.

10. An improved developer composition in accordance with claim 1 wherein the first resin particles contain therein polypropylene wax, or polyethylene wax, of a molecular weight of from about 1,000 to about 5,000.

11. An improved developer composition in accordance with claim 1 wherein the colloidal silica additive particles are present in an amount of from about 0.1 percent by weight to about 1 percent by weight, based on the weight of the toner particles and the fatty acid metal salt additive particles are present in an amount of from about 0.1 percent by weight to about 1 percent by weight, based on the weight of the toner particles.

12. An improved developer composition in accordance with claim 1 wherein the colloidal silica particles are present in an amount of about 0.7 percent by weight.

13. An improved developer composition in accordance with claim 1 wherein the fatty acid metal salt additive particles are present in an amount of from about 0.1 percent by weight to about 0.80 percent by weight, based on the weight of the toner particles.

14. An improved developer composition in accordance with claim 1 wherein the low molecular weight wax material is present in an amount of from about 1 percent by weight to about 10 percent by weight, based on the weight of the toner composition.

15. An improved developer composition in accordance with claim 1 wherein the low molecular weight wax material is present in an amount of from about 2 percent by weight to about 5 percent by weight.

16. An improved developer composition in accordance with claim 1 wherein the first resin particles are present in an amount of from about 30 percent by weight to about 75 percent by weight, and the second terpolymer resin particles are present in an amount of from about 15 percent by weight to about 60 percent by weight.

17. An improved developer composition in accordance with claim 1 wherein the pigment particles are present in an amount of from about 2 percent by weight to about 15 percent by weight.

18. An improved developer composition in accordance with claim 10, wherein the polyethylene is of a molecular weight of from about 1,000 to about 1,500.

19. An improved developer composition in accordance with claim 10, wherein the molecular weight of the polypropylene is from about 4,000 to about 5,000.

20. An improved developer composition in accordance with claim 1, wherein the developer possess a stable triboelectric charging value of from about 10 microcoulombs per gram to about 40 microcoulombs per gram.

21. An improved developer composition in accordance with claim 1, wherein the carrier particles are of a conductivity of from about $10^{-9}$ ohm/cm $(-1)$ to about $10^{-12}$ ohm/cm $(-1)$.

22. An improved developer composition in accordance with claim 1, wherein the breakdown potentials for the carrier particles is greater than 1,000 volts.

23. An improved developer composition in accordance with claim 1, wherein the conductivity sensitivity parameter for the developer composition is from about 0.1 to about 0.9.

24. An improved stable two-component conductive developer having a toner composition consisting essentially of (1) from about 30% by weight to about 75% by weight of first resin particles of styrene methacrylate copolymers grafted with or containing a waxy material selected from the group consisting of polyethylene of a molecular weight of from about 1,000 to about 1,500, and polypropylene of a molecular weight of from about 1,000 to about 5,000, (2) second resin particles of a styrene, acrylate, acrylonitrile terpolymer, (3) pigment particles, (4) colloidal silica additive particles, (5) fatty acid metal salt additive particles, and uncoated ferrite carrier particles, and wherein the resulting composition has a stable triboelectric charge of from about 10 microcoulombs per gram to about 40 microcoulombs per gram, and the carrier conductivity is from about $10^{-9}$ ohm/cm $(-1)$ to about $10^{-12}$ ohm/cm $(-1)$, with the conductivity sensitivity parameter of this composition being from about 0.1 to about 0.9.

* * * * *